US005179806A

United States Patent [19]

Brown et al.

[11] Patent Number: 5,179,806

[45] Date of Patent: Jan. 19, 1993

[54] METHOD AND APPARATUS FOR BUFFING A TIRE SIDEWALL

[75] Inventors: Robert L. Brown, Hartville; Thomas E. Codispoti, Akron; Kenneth W. Dunaway, Massillon, all of Ohio

[73] Assignee: General Tire, Inc., Akron, Ohio

[21] Appl. No.: 647,081

[22] Filed: Jan. 29, 1991

[51] Int. Cl.[5] ..... B24B 49/00

[52] U.S. Cl. ..... 51/165.71; 51/165.8; 51/42; 51/89; 51/106 R; 51/281 R

[58] Field of Search ..... 51/42, 50 R, 51, 289 R, 51/165.77, 165.8, 165.71, DIG. 33, 89, 281 R, 106 R

[56] References Cited

U.S. PATENT DOCUMENTS

| | | | |
|---|---|---|---|
| 1,956,331 | 4/1934 | Mullin | 51/42 |
| 2,707,851 | 5/1955 | Strong | 51/106 R |
| 2,986,849 | 6/1961 | Clark | 51/281 R |
| 3,001,334 | 9/1961 | Giusti et al. | 51/51 |
| 3,137,976 | 6/1964 | Cooper | 51/106 R |
| 3,290,831 | 12/1966 | Laube | 51/106 R |
| 3,521,408 | 7/1970 | Neugebauer | 51/106 R |
| 4,663,889 | 5/1987 | Strand | 51/281 R |

*Primary Examiner*—Robert A. Rose

*Attorney, Agent, or Firm*—Calfee, Halter & Griswold

[57] ABSTRACT

An apparatus is provided for removing material from the sidewall of a tire. The apparatus may be used for removing the thin layer of black rubber that normally covers the white letters or white stripe of the sidewall of a newly cured tire, and for buffing the surfaces of such white letters or stripes to give them a smooth finish. The apparatus may also be used for buffing black portions of a tire sidewall to give those portions a smooth finish. The apparatus includes a cutting device and a sensor mounted on a moveable carriage. The sensor measures the distance between the cutting device and a portion of the tire sidewall adjacent to the portion to be buffed. As the tire rotates while it is being buffed, the carriage moves in response to the sensor's measurement toward or away from the tire sidewall, so that the cutting device removes material at a constant height relative to the adjacent portion of the sidewall.

10 Claims, 5 Drawing Sheets

METHOD AND APPARATUS FOR BUFFING A TIRE SIDEWALL

FIELD OF THE INVENTION

This invention relates to the manufacture of tires, and in particular to the final finish and buffing of a tire sidewall after the tire has been cured.

BACKGROUND OF THE INVENTION

In the manufacture of tires having white letters or white stripes on their sidewalls, the usual practice is to mold the tire with a thin layer of black rubber covering the white letters or stripes. This black rubber must then be removed to expose the white material that lies underneath. To accomplish that task, the tire is usually mounted on the chuck of a rotatable spindle and a buffing wheel is moved into position next to the letters or striping on the sidewall. The tire is then rotated and the buffing wheel is moved toward the annular portion of the sidewall having the letters or stripes to be finished. The grinding wheel is gradually moved inwardly against the tire surface, until all portions of the letter or stripes around the circumference of the sidewall have had their black cover layer removed and have been properly finished to the appearance standards of the manufacturer.

Often, black sidewall tires, particularly high performance tires, are finished using the same buffing procedure and apparatus as used on white sidewall tires. Of course, in the case of black sidewall tires, the only purpose of that buffing is to improve the finish and appearance of certain portions of the tire sidewall, usually the letters that spell out the brand name of the tire.

One problem experienced with this conventional method and apparatus for finishing tire sidewalls is that the sidewall of tires have slight variations about their circumference, when compared to the plane of the tire's rotation. The buffing wheel does not take this dimensional variation of the tire into account while it is grinding the letters or stripes. Consequently, the letters or the stripes have their surfaces ground so that they lie in a common plane perpendicular to the axis of rotation of tire, while the adjacent unground portions of the tire sidewall vary with respect to that plane. Thus, the letter or stripes end up raised or indented at different levels above or below the tire surface. Normally, such differences are not enough to attract the attention of most observers, but they can make the finishing of some tires difficult. Also, the sidewall surfaces of tires that require buffing must usually be raised above the sidewalls of the tires, rather than indented, because of the danger of the buffing wheel cutting too close to the tire cords at the portions of the sidewall that protrude the most from the plane of rotation of the tire. It would save rubber if the portions of the sidewall to be buffed were indented rather than raised with respect to other portions of the sidewall.

The present invention solves the foregoing problem of removing material from a portion of a tire sidewall by mounting a sensor on the carriage that carries the grinding wheel or other cutting device. The sensor measures the distance of between the cutting device and a portion of the tire sidewall adjacent to the portion of the sidewall from which material is to be removed. As the tire rotates while the cutting device is removing material, the carriage moves in response to the sensor's measurement toward or away from the tire sidewall, so that the cutting device removes material at a constant level relative to the adjacent portion of the sidewall.

The treads of tires are frequently buffed to correct minor force variations and out-of-roundness. Machines that do such buffing have sensors which measure the tire's runout (roundness). However, those sensors are usually mounted separately from the carriage holding the grinding wheel, for instance the sensor 85 in FIG. 3 of U.S. Pat. No. 3,724,137 to Hofelt and Corl. Also, such sensors measure the tire runout on the same portion of the tire surface to be buffed. Their purpose is to detect those places on the circumference of the tire that protrude the most from the axis of the tire so that they can be buffed by the separately mounted buffing device. The apparatus and method of the present invention differs from such tread buffing systems, in that the sensor is mounted on the same carriage that carries the buffing device and is positioned to detect the circumferential variations of the tire surface on a portion laterally adjacent to the portion to be buffed. The buffing device does not remove material from the portion of the tire measured by the sensor, nor does it attempt to correct the variations measured by the sensor. Instead, the sensor feeds its measured surface variations back to a computer which adjusts the movement of the carriage on which the sensor is mounted, so that the carriage and a buffing device on the carriage conforms to those variations, as it removes material from another portion of the tire surface.

U.S. Pat. No. 4,084,350 to Ongaro shows a force and runout correction machine for tire treads of a different design. In FIG. 3, a sensor 126 is mounted on the same carriage as a buffing wheel 114. However, this sensor, like that of U.S. Pat. No. 3,724,137, is positioned to measure the runout of the same circumferential stripe on the tire tread that is to be cut by the buffing wheel. As described in column 9, lines 52 to 68 of the patent, the purpose of the sensor is to detect the high points on the portion of the tire to be buffed so that the buffing wheel can be initially spaced at a safe distance away from those high points. Also, according to column 13, lines 47 to 68, the runout variations measured by the sensor are used to determine whether they are within the limits such that it is appropriate to buff the tire. There is no feedback between the sensor and the carriage holding the buffing wheel that enables the buffing wheel to follow the runout variations measured by the sensor, as there is in the method and apparatus of the present invention.

SUMMARY OF THE INVENTION

An object of the present invention is to improve the method and means by which portions of tire sidewall surfaces are buffed, so that the buffed surfaces will remain a constant distance above or below the adjacent portions of the tire sidewall, regardless of any circumferential variations that occur in the bulge of the sidewall from the plane of rotation of the tire.

Another object of the present invention is to improve the method and means for finishing tire sidewalls, so that the finished portions have smooth surfaces that are free of rough flanged edges.

These and other objects of the invention are achieved by a method and apparatus that includes base for supporting a tire for rotation about an axis, drive means for rotating the tire about said axis, a carriage mounted adjacent a sidewall surface of the tire and moveable toward and away from the sidewall surface in a direction substantially parallel to the axis of rotation of the tire and a cutting device mounted on the carriage for removing material from the said one portion of the sidewall surface. On the carriage is mounted a sensor that is spaced radially from the cutting device in relation to the axis of rotation of the tire and is positioned to measure the distance between said cutting device and a second portion of the sidewall surface that is also spaced radially from the first portion relative to the axis of rotation of the tire.

A computer is connected to said sensor for comparing the distance measured by the sensor with a desired distance. Also, a drive motor responsible to the computer moves the carriage and the cutting device mounted on said carriage toward or away from the first portion of the sidewall surface, so that during the rotation of the tire the distance between the cutting device and the second portion of the sidewall surface is substantially equal to the desired distance and the cutting device on the carriage cuts the first portion of the sidewall surface at a level that is spaced at a constant axial distance from the second portion of the sidewall surface.

DESCRIPTION OF THE PREFERRED EMBODIMENT

Figure 1:
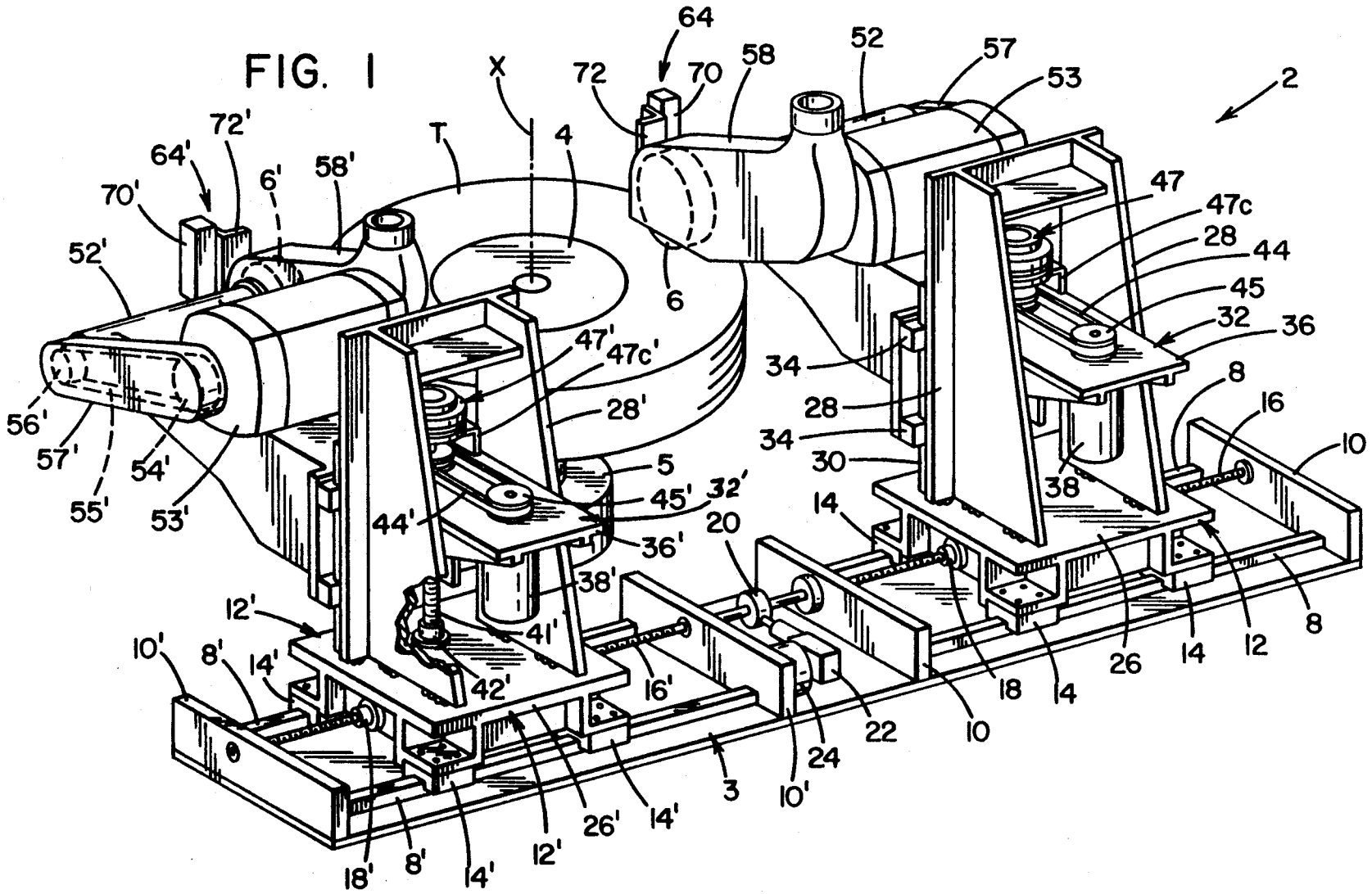
FIG. 1 is a perspective view of an apparatus for buffing tire sidewalls, illustrating one embodiment of the present invention.
Figure 2:
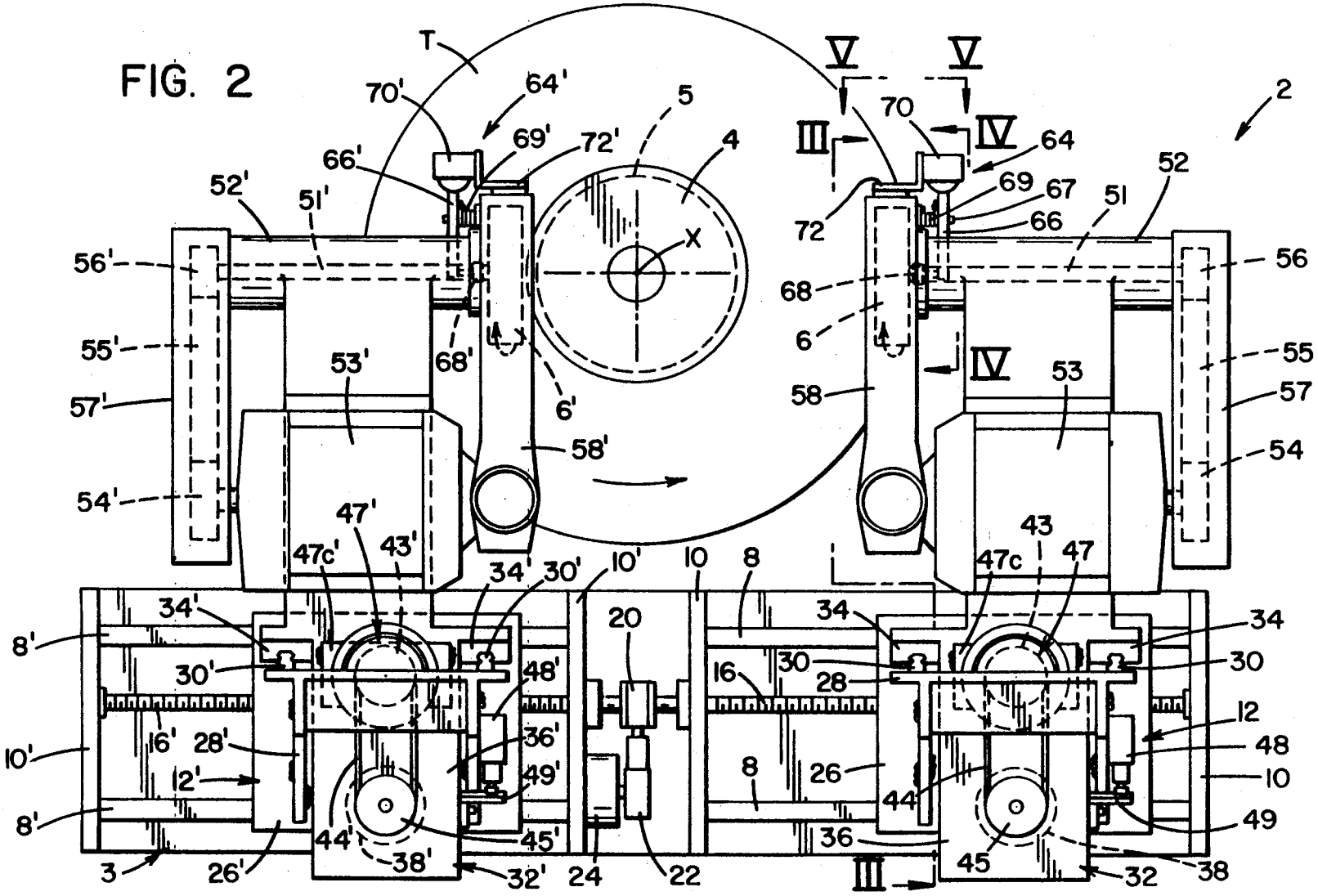
FIG. 2 is a top view of the apparatus of FIG. 1.

Referring to FIGS. 1 and 2, a buffing apparatus 2 a base 3 supports a tire chuck 4 on which an inflated tire T is rotatably supported about an axis X. A variable speed motor 5 drives the tire T at a speed of between 6 and 30 revolutions per minute. The base 3 supports two buffing devices for cutting portions of the sidewall surfaces of tire T, namely a finish buffing wheel 6 and a rough buffing wheel $6^1$ (FIG. 2). Both buffing wheels 6 and $6^1$ are supported in exactly the same manner and the machine parts employed for controlling the buffing wheels 6 and $6^1$ are exactly the same. Therefore, only the parts associated with the finish buffing wheel 6 will be described, with the understanding that such descriptions also apply to the corresponding parts associated with the rough buffing wheel $6^1$.

In FIG. 1, a pair of guide rods 8 are mounted between end support blocks 10 of the base 3. A frame 12 slides on the guide rods 8, being connected to the guide rods through bushings 14. A threaded shaft 16 is rotatably mounted on the support blocks 10 and threadably engages a threaded collar 18 mounted on the frame 12. The threaded shaft 16 is driven by a main gear 20 connected through a gear reducer 22 to a motor 24. The motor 24 thus drives the threaded shaft 16 to move the frame 12 back and forth on the guide rods 8. The motor 24, gear reducer 22 and main gear 20 also drive the threaded shaft $16^1$ associated with the rough buffing wheel $6^1$ and are the only parts that are not duplicated and are used in the operation of both buffing wheels 6 and $6^1$.

Figure 3:
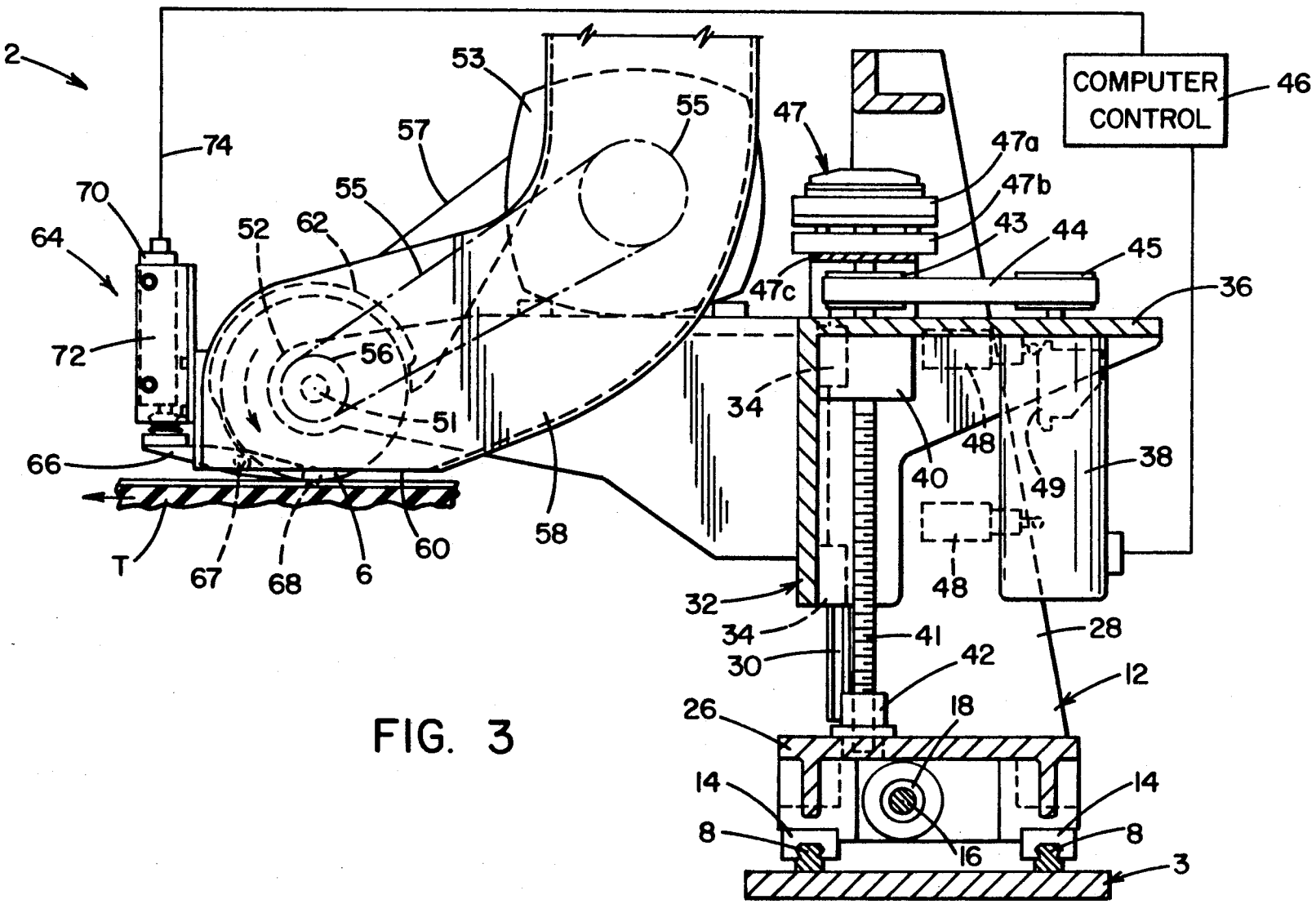
FIG. 3 is a sectional view of the apparatus of FIGS. 1 and 2, taken along line III—III of FIG. 2.

Referring to FIGS. 2 and 3, frame 12 includes a platform 26 and a standing support 28 on which two vertical guide ways 30 are mounted. A carriage 32 is slidably mounted on the guide ways 30, through bushings 34. A platform 36 on the carriage 32 supports a motor 38 and also a bearing housing 40 which rotatably supports a threaded shaft 41. The threaded shaft 41 turns in a threaded ball nut 42 mounted on the platform 26 of frame 12. A pulley wheel 43 is mounted on the threaded shaft 41 and is connected by a toothed belt 44 to a pulley wheel 45 connected to the motor 38. Thus, the motor 38 rotates the threaded shaft 41 to slide the carriage 32 along the guide ways 30 of the frame 12. The motor 38 is either a stepper motor or a servo-motor which reacts to commands from a computer control 46 (shown diagrammatically in FIG. 3) to turn the threaded shaft 41 in discreet increments as it moves the carriage 32 along guide ways 30.

A pneumatically operated disc brake 47 is mounted at the top end of the threaded shaft 41. The brake 47 includes an upper rotating disc 47*a* keyed to the shaft 41 and a lower stationary disc 47*b* that moves into engagement with the top disc 47*a* when the motor 38 is not operating, in order to keep the threaded shaft 41 from rotating. The disc brake 47 is supported on a platform 47*c* mounted on the platform 36 of carriage 32. Also, as shown in FIGS. 1 and 3, two limit switches 48 are mounted on the standing support 28, which engage an arm 49 extending from the side of the carriage 32. The limit switches 48 turn off the motor 38, which also thereby engages the brake 47, whenever the carriage 32 reaches its upper or lower limit of travel.

As shown in FIG. 2, the platform 36 of the carriage 32 also supports the buffing wheel 6, connected to a shaft 51, rotatably mounted in a tubular bearing housing 52 and a drive motor 53. A pulley wheel 54 mounted on the shaft of drive motor 53 is connected by a belt 55 to a pulley wheel 56 on the opposite end of shaft 51 from the buffing wheel 6. The pulley wheels 54 and 56 and connecting belt 55 are covered by a housing 57.

A shroud 58 (FIGS. 2 and 3) is mounted on the ends of housing 52 and motor 53. The shroud 58 surrounds the buffing wheel 6, leaving only the lower grinding surface of the wheel 6 exposed at the opening 60 in the shroud 58. The shroud 58 is connected at its upper end to a discharge tube (not shown), designed to convey away particles of rubber removed from the tire T by the wheel 6. Preferably, there is a baffle 62 (FIG. 3) in the shroud 58 to aid in directing the rubber particles toward the upper end of the shroud.

Figure 4:
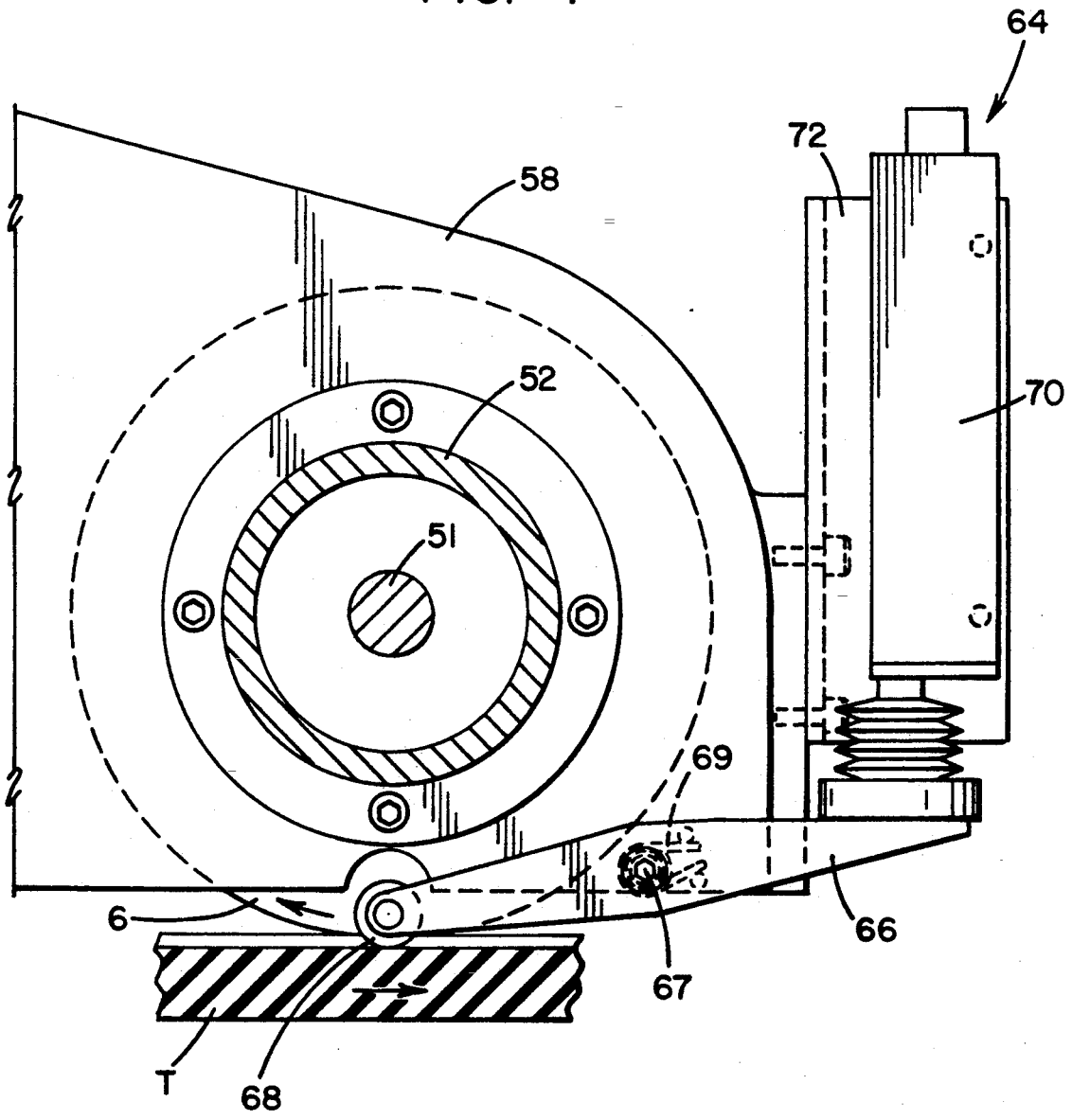
FIG. 4 is a partial sectional view of the apparatus of FIGS. 1 and 2, taken along line IV—IV of FIG. 2.
Figure 5:
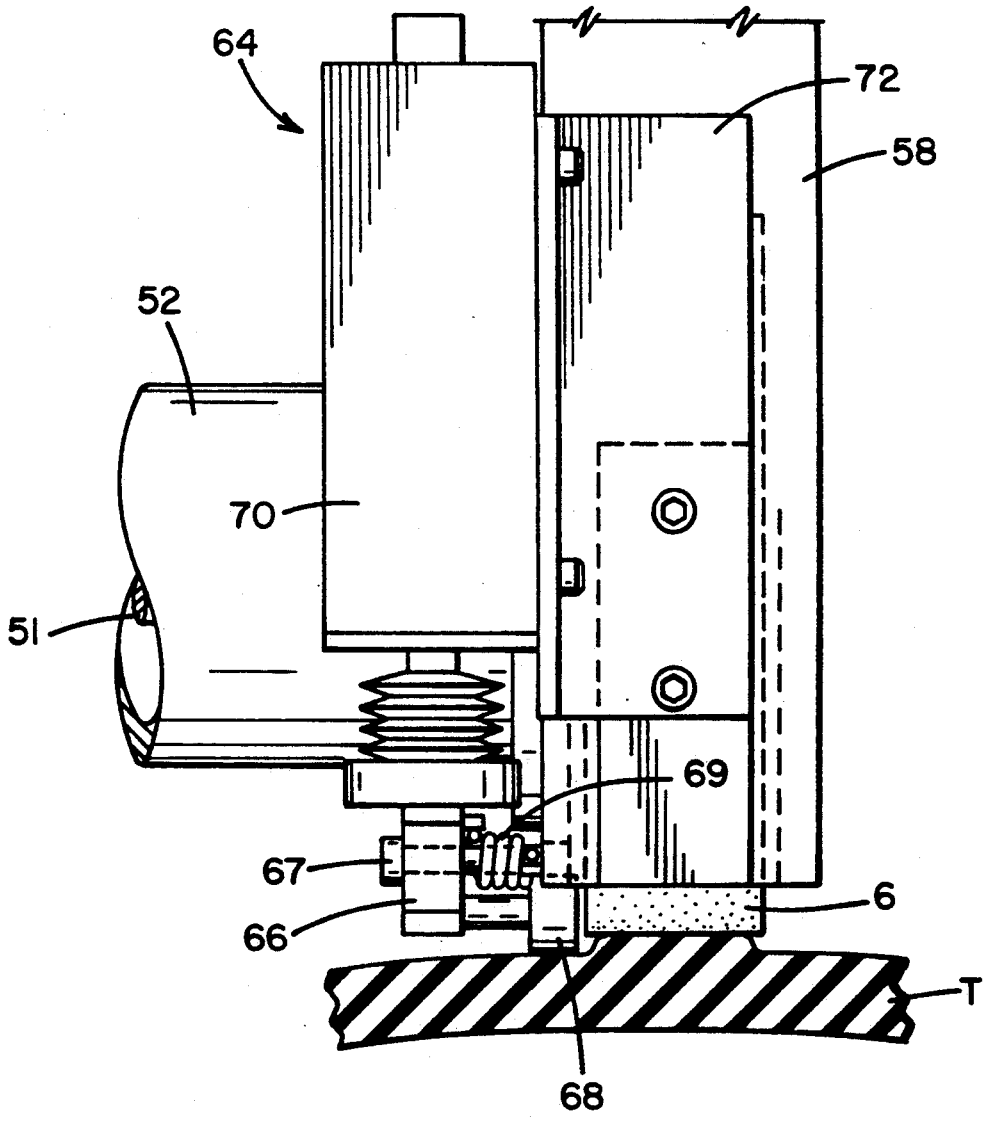
FIG. 5 is a partial view of the apparatus of FIGS. 1 and 2, taken along line V—V of FIG. 2.

A sensor device 64, best seen in FIGS. 4 and 5, is mounted on the forward end of the shroud 58. The sensor device 64 includes a lever 66 that rotates about a pin 67 mounted on the shroud 58. The lever 66 extends along the side of the shroud 58 and the buffing wheel 6 and terminates at a lower end where a small wheel 68 is mounted. As shown in FIG. 5, the wheel 68 is designed to contact a portion of the tire T at a location that is spaced radially from the white sidewall portion of the tire that is contacted by the buffing wheel 50. The lever 66 is spring loaded by means of a spring 69 surrounding the pin 67 so that the wheel 68 is naturally forced down onto the surface of the tire T.

At its upper end, the lever 66 is connected to a transducer 70 mounted on a bracket 72 connected to the front end of the shroud 58. The transducer 70 may be either a linear variable differential transformer or a transducer that produces digital pulses, the number of pulses being proportioned to the displacement of the upper end of the lever 66. As the lever 66 rotates in response to the movement of the wheel 68 on a portion of a rotating tire T, the transducer 70 records the circumferential variations in the portion of the tire T contacted by the wheel 68. The transducer 70 is connected by wires 74 (FIG. 3) to the computer control 46, and the circumferential variations in the surface of tire T are fed through wires 74 to the computer control 46.

In the operation of the apparatus 2, a tire T is mounted on a chuck 4 and rotated by the motor 5 at a speed of between 6 and 30 revolutions per minute. The speed of the tire rotation will depend on the finishing requirements of the final buffing, and it may be desirable to slow the tire down during the final steps of buffing.

The rough buffing wheel $6^1$ and the finish buffing wheel 6 are moved to the proper radial distance from the axis X of the tire T by operating the motor 24 to move the frames 12 and $12^1$ inwardly or outwardly with respect to the axis X. Of course, the radial positioning of the wheels 6 and $6^1$ depends on the position the letters or stripes on the tire from which material is to be removed.

With the drive motors 53 and $53^1$ rotating buffing wheels 6 and $6^1$ at approximately 8,000 revolutions per minute, the computer control 46 activates each of the motors 38 and 381 independently to move the buffing wheels, 6 and $6^1$ into their respective buffing positions. These positions will be determined by the initial level of the portion of the tire sidewall to be ground, in relation to the level of the adjacent portion of the tire sidewall on which the wheels 68 and $68^1$ on levers 66 and $66^1$ are designed to ride.

When the wheel 68 strikes the sidewall of the tire T, the transducer 70 will send a signal to the computer control 46 indicating the vertical spacing between the wheel 68 and the buffing wheel 6. Likewise, the wheel $68^1$ will signal the computer control 46 to indicate the spacing between the vertical wheel $72^1$ and the buffing wheel $6^1$.

The computer control 46 will then compare these spacings with the desired levels at which the buffing wheels 6 and $6^1$ are to begin buffing. These desired buffing levels are pre-programmed into the computer control 46. The computer control 46 will send an appropriate command to the motors 38 and $38^1$ to move the buffing wheel 6 and $6^1$ into their buffing positions. As the tire T rotates, the wheels 68 and $68^1$ will move with any variations in the portion of the sidewall surface adjacent to the portions to be buffed. Those movements will be sensed by the transducers 70 and $70^1$ and communicated back to the computer control 46, which will operate the motors 38 and $38^1$ to adjust the carriages 32 and $32^1$ so that both carriages at all times hold the buffing wheels 6 and $6^1$ at their desired buffing distances above or below the adjacent surface of the tire sidewall on which the wheels 68 and $68^1$ are riding.

The rough buffing wheel $6^1$ preferably rotates in the same direction as the finish grinding wheel 6, so that material is removed from the tire in opposite directions as the tire rotates. Material is removed from the tire sidewall in small amounts by controlling the desired buffing levels that are pre-programmed into the computer control 46. As the computer control 46 changes the desired cutting levels the buffing wheels 6 and $6^1$ are moved further into the portion of tire sidewall being buffed. However, during any given rotation of the tire, the distance between the cutting level and the level of the adjacent surface portion of the tire sidewall remains constant for each buffing wheel, because of the control obtained by the sensor devices 64 and $64^1$.

Normally, the computer control 46 will be programmed to cause the finish buffing wheel $6^1$ to advance at greater cutting depths into the tire surface than the rough buffing wheel 6. Because the buffing wheels are cutting the tire surface in opposite directions, the finish buffing wheel 6 will remove any burrs or flanges left on the rears of the tire elements being buffed by the rough buffing wheel $6^1$.

The computer control 46 may be programmed to execute any desired sequence of rough buffing and finish buffing steps on the sidewall portion of the tire to be ground. The advantage of the present invention is that no matter what those steps are, during each revolution of the tire both the rough buffing wheel $6^1$ and the finish buffing wheel 6 will cut the portion of the sidewall to be finished at its own respective desired height above or below the adjacent surface of the sidewall and that height will remain constant, even though the adjacent sidewall surface varies circumferentially in relation to the plane in which the tire T is rotating.

While one embodiment of the present invention has been thus shown and described, it will be apparent that changes may be made in the details of the method and apparatus presented, without departing from the spirit of the invention as defined in the following claims.

We claim:

1. An apparatus for removing material from a first portion of a sidewall surface of a tire, including a base for supporting the tire for rotation about an axis, drive means mounted on said base for rotating the tire about said axis, a carriage mounted on said base adjacent said sidewall surface and moveable toward and away from said sidewall surface in an axial direction, namely a direction substantially parallel to the axis of rotation of the tire, and a cutting device mounted on said carriage for removing material from the said first portion of the sidewall surface, wherein the improvement comprises:

(a) a sensor device mounted on said carriage and spaced radially from said cutting device in relation to the axis of rotation of the tire and positioned to contact a second portion of the sidewall surface that is spaced radially from said first portion relative to the axis of rotation of the tire and to measure the axial distance between said second portion and said cutting device;

(b) a computer control device connected to said sensor device for detecting a difference between the axial distance measured by said sensor device and a desired axial distance, said computer control generating a command when said difference is detected, (c) a drive device connected to said carriage for moving said carriage and the cutting device mounted on said carriage toward or away from said first portion of the sidewall surface, said drive device also being connected to said computer control device to receive commands from the computer control device and to move said carriage in response to said commands to maintain the axial distance between the cutting device and the second portion of the sidewall surface substantially equal to the desired axial distance, so that the cutting device cuts the first portion of the sidewall surface at a level that is spaced at said desired axial distance from the second portion of the sidewall surface.

2. The apparatus of claim 1 wherein the sensor device comprises a lever that is pivotally connected to said carriage, a wheel rotatably mounted on an end of said lever, said wheel positioned to contact said second portion of the sidewall surface and cause said lever to rotate in response to changes in the position of said second portion of the sidewall surface relative to the plane of rotation of the tire, and a transducer connected to the opposite end of said lever from said wheel, said transducer recording the distance between said cutting device and said second portion of the sidewall surface of the tire.

3. The apparatus of claim 2 wherein said transducer is a linear vehicle differential transformer.

4. The apparatus of claim 1 wherein the improvement comprises:

(d) a frame for supporting said carriage having a track extending in a direction substantially parallel to said axis of rotation of the tire, said carriage slidably mounted on said track, and said drive device (c) including:

(1) a drive motor mounted on said carriage, (2) a threaded shaft connected to and rotatably driven by said drive motor, said threaded shaft extending substantially parallel to said axis of rotation of the tire, (3) a threaded ball nut mounted on said frame and threadably engaging said threaded shaft so as to move said carriage forward or away from said first portion of the sidewall surface in response to the operation of said drive motor, said drive motor being controlled by an electrical connection to said computer control device (b) to rotate said threaded shaft and move said carriage and the cutting device mounted thereon toward or away from said first portion of the tire sidewall surface in response to the command generated by said computer control device.

5. Apparatus of claim 4 wherein the improvement comprises:

(e) a second track mounted on said base extending in a radial direction in respect of the axis of rotation of said tire, said frame slidably mounted on said second track and (f) a second drive device for moving said frame to adjust the radial location of the cutting device in respect of the axis of rotation of the tire, said second drive device comprising:

(1) a second drive motor mounted on said frame;

(2) a second threaded shaft connected to and rotatably driven by said second drive motor, said second threaded shaft extending in a substantially radial direction in respect of the axis of rotation of the tire;

(3) a second threaded collar threadably engaging said threaded shaft and fixed to said frame so as to move said frame to adjust the radial location of said cutting device in respect of the axis of rotation of the tire.

6. A method of removing material from a first portion of a sidewall surface of a tire, including the steps of rotating the tire about an axis and moving a cutting device in an axial direction, namely a direction substantially parallel to said axis of the tire, into engagement with said first portion of the sidewall surface, wherein the improvement comprises the steps of:

(a) measuring with a sensor device having a fixed position relative to said cutting device the axial distance between said cutting device and a second portion of the sidewall surface of the tire that is spaced radially from said first portion relative to the axis of rotation of the tire;

(b) determining the difference between the distance measured by the sensor device and a desired distance;

(c) in response to the difference between the distance measured in step (b), moving the cutting device in said axial direction toward or away from said first portion of the sidewall surface, so that during the rotation of the tire the distance between the cutting device and the second portion of the sidewall surface is maintained substantially equal to the desired distance and the cutting device cuts the first portion of the sidewall surface at a level that is spaced at a constant axial distance from the second portion of the sidewall surface.

7. The method of claim 6 wherein the improvement also comprises the step (d) of progressively changing the desired axial distance between the cutting device and the second portion of the sidewall surface of the tire, so that material is removed from the first portion of the sidewall surface in small amounts.

8. The method of claim 7 wherein the steps (a), (b), (c) and (d) are preformed by two cutting devices and two sensor devices spaced circumferentially from one another in respect to the tire axis, the desired axial distance between one cutting device and the second portion of the sidewall surface of the tire being progressively changed to remove greater amounts of material from the first portion of the sidewall surface than the progressive changes in the desired distance between the other cutting device and the second portion of the sidewall surface of the tire.

9. The method of claim 8 wherein the two cutting devices are buffing wheels and said buffing wheels are rotated in opposite directions in respect of the movement of said first portion of the sidewall surface of the tire, so that one cutting device removes burrs left on said portion of the sidewall surface by the other cutting device.

10. The apparatus of claim 1 wherein the sensor device is positioned to contact said second portion of the sidewall surface of the tire at a location that is substantially on the radial line between the axis of the tire and said cutting device.

* * * * *